US008100520B2

(12) United States Patent
Lee et al.

(10) Patent No.: US 8,100,520 B2
(45) Date of Patent: Jan. 24, 2012

(54) INKJET PRINTHEAD AND METHOD OF REMOVING BUBBLES IN THE SAME

(75) Inventors: You-seop Lee, Yongin-si (KR); Jong-min Kim, Suwon-si (KR); Jae-woo Chung, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 737 days.

(21) Appl. No.: 11/531,773

(22) Filed: Sep. 14, 2006

(65) Prior Publication Data

US 2007/0211123 A1 Sep. 13, 2007

(30) Foreign Application Priority Data

Feb. 14, 2006 (KR) ..... 10-2006-0014247

(51) Int. Cl.
*B41J 2/19* (2006.01)

(52) U.S. Cl. ..... 347/92

(58) Field of Classification Search ..... 347/54, 347/92, 9, 12, 55, 56, 68, 87; 204/547, 562; 355/30

See application file for complete search history.

(56) References Cited

U.S. PATENT DOCUMENTS 4,624,764 A * 11/1986 Mintz et al. ..... 204/562
5,814,200 A * 9/1998 Pethig et al. ..... 204/547
6,315,395 B1 * 11/2001 Imai ..... 347/56
6,332,668 B1 * 12/2001 Ahn ..... 347/54
7,419,574 B2 * 9/2008 Cummings et al. ..... 204/547
2002/0041311 A1 * 4/2002 Oishi ..... 347/68
2004/0026250 A1 * 2/2004 Cummings et al. ..... 204/547
2005/0062816 A1 * 3/2005 Yildirim et al. ..... 347/92
2005/0174549 A1 * 8/2005 Duineveld et al. ..... 355/30
2005/0219323 A1 * 10/2005 Kusakari ..... 347/55
2005/0219338 A1 * 10/2005 Kusakari ..... 347/87
2005/0225734 A1 * 10/2005 De Smit et al. ..... 355/30

FOREIGN PATENT DOCUMENTS

JP 60090765 A * 5/1985
JP 64-028623 1/1989
JP 06-262005 9/1994
JP 2000-006393 1/2000

OTHER PUBLICATIONS

Japanese Office Action issued Sep. 13, 2011 in JP Application No. 2007-033849.

* cited by examiner

*Primary Examiner* — Stephen Meier
*Assistant Examiner* — Carlos A Martinez
(74) *Attorney, Agent, or Firm* — Stanzione & Kim, LLP

(57) ABSTRACT

An inkjet printhead includes an ink flow channel including a pressure chamber, a nozzle to communicate with the pressure chamber, an actuator to provide a driving force to eject ink from the pressure chamber, and a plurality of electrodes, a lower voltage is applied to an electrode closer to the nozzle as compared to an electrode farther from the nozzle to form a non-uniform electric field in the ink flow channel, and a method of removing bubbles in the inkjet printhead.

12 Claims, 4 Drawing Sheets

INKJET PRINTHEAD AND METHOD OF REMOVING BUBBLES IN THE SAME

CROSS-REFERENCE TO RELATED APPLICATIONS

This application claims priority under 35 U.S.C. §119(a) from Korean Patent Application No. 10-2006-0014247, filed on Feb. 14, 2006, in the Korean Intellectual Property Office, the disclosure of which is incorporated herein in its entirety by reference.

BACKGROUND OF THE INVENTION

1. Field of the Invention

The present general inventive concept relates to an inkjet printhead to remove bubbles and a bubble removing method of the same.

2. Description of the Related Art

Generally, inkjet printheads are devices for printing a color image on a printing medium by firing droplets of ink onto a desired region of the printing medium. Depending on the ink ejecting method, the inkjet printheads can be classified into two types: thermal inkjet printheads and piezoelectric inkjet printheads. The thermal inkjet printhead generates bubbles in ink to be ejected by using heat, and ejects the ink using an expansion of the bubbles. On the other hand, the piezoelectric inkjet printhead ejects ink using a pressure generated by deforming a piezoelectric material.

An ink flow channel in the printhead, in particular, a pressure chamber, should be filled with ink. Air flows through a nozzle of the printhead during printing, and the air and other gases dissolved in the ink grow into bubbles due to a temperature rise or other factors. The bubbles existing in the ink flow channel in the printhead, in particular, in the pressure chamber, degrades an ejection performance of the printhead. Also, as the temperature increases, the bubbles expand. This upsets a pressure balance of the ink in the printhead, which may cause the ink to leak through the nozzle.

In order to remove the bubbles, a method of forcibly sucking the ink through the nozzle using a vacuum pump has been used. However, the bubbles in a corner of the ink flow channel, in particular, in the pressure chamber, are not easily removed even using this conventional forcible sucking method.

SUMMARY OF THE INVENTION

The present general inventive concept provides an inkjet printhead in which bubbles can be removed and a bubble removing method of the same.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an inkjet printhead, including an ink flow channel including a pressure chamber to contain ink, a nozzle to communicate with the pressure chamber, an actuator to provide a driving force to eject the ink from the pressure chamber, and a plurality of electrodes to receive voltages to form a non-uniform electric field in the ink flow channel such that an electrode closer to the nozzle receives a lower voltage relative to an electrode farther from the nozzle.

The voltages may be variable-frequency, traveling-pulse voltages.

The plurality of electrodes may be disposed on walls forming the ink flow channel.

The foregoing and/or other aspects and utilities of the present general inventive concept may also be achieved by providing a method of removing bubbles in an inkjet printhead including an ink flow channel having a pressure chamber to contain ink, a nozzle to communicate with the pressure chamber, an actuator to provide an ink ejecting force to the pressure chamber, and a plurality of electrodes disposed in the ink flow channel, the method including applying voltages to the plurality of electrodes such that a lower voltage is applied to an electrode closer to the nozzle relative to an electrode farther from the nozzle, moving bubbles to the nozzle by a non-uniform electric field formed by the plurality of electrodes and dielectrophoresis generated by dipole moments of the bubbles, and discharging the bubbles through the nozzle.

The discharging of the bubbles may include discharging the bubbles together with the ink through the nozzle.

The discharging of the bubbles may include applying a negative pressure to the nozzle to suck the bubbles out of the pressure chamber through the nozzle.

The voltages applied to the plurality of electrodes may be variable-frequency, traveling-pulse voltages to accelerate the bubbles.

The foregoing and/or other aspects and utilities of the present general inventive concept may also be achieved by providing a printhead, including a chamber layer including an ink chamber to contain ink, a nozzle layer disposed on the chamber layer and including a nozzle in communication with the ink chamber to eject the ink from the ink chamber, an actuator to provide a driving force to eject the ink from the ink chamber through the nozzle, and a plurality of electrodes to move bubbles in the ink contained in the ink chamber to the nozzle.

The plurality of electrodes may move the bubbles in the ink to the nozzle using dielectrophoresis. The plurality of electrodes may generate a non-uniform electric field in the ink chamber to dielectrically polarize the bubbles and applies a force to move the polarized bubbles towards the nozzle.

The plurality of electrodes may be disposed on a wall of the ink chamber. Shapes of at least a portion of the plurality of electrodes may be non-uniform shapes. The non-uniform shapes may include at least one of a flat panel shape extending in a width direction of the ink chamber, and a flat panel shape including branches protruding in a length direction of the ink chamber. The printhead may further include a voltage applying unit to apply voltages to the plurality of electrodes. The voltage applying unit may apply a first voltage to a portion of the plurality of electrodes disposed closer to the nozzle, and may apply a second voltage to a portion of the plurality of electrodes disposed farther from the nozzle. The first voltage may be lower than the second voltage. The voltages applied by the voltage applying unit may be variable-frequency traveling pulse voltages to accelerate the movement of the bubbles towards the nozzle.

The actuator may be selected from a thermal actuator and a piezoelectric actuator. The chamber layer may further include a manifold to supply ink to the ink chamber, and a restrictor to restrict a back flow of ink from the ink chamber to the manifold.

The foregoing and/or other aspects and utilities of the present general inventive concept may also be achieved by providing a method of removing bubbles from a printhead including an ink chamber to contain ink and a nozzle in communication with the pressure chamber to eject the ink, the method including generating a non-uniform electric field in the ink chamber to dielectrically polarize bubbles in the ink and to apply a force to move the polarized bubbles towards the nozzle, and ejecting the bubbles from the ink chamber through the nozzle by applying a negative pressure to the nozzle.

The generation of the non-uniform electric field may include applying voltages to electrodes disposed in the ink chamber. Shapes of at least a portion of the electrodes may be non-uniform shapes. The applying of the voltages to the electrodes may include applying a lower voltage to a portion of the electrodes closer to the nozzle and applying a higher voltage a portion of the electrodes farther from the nozzle to move the polarized bubbles towards the nozzle.

The foregoing and/or other aspects and utilities of the present general inventive concept may also be achieved by providing a method of removing bubbles from a printhead, including gathering bubbles around a nozzle of the printhead by dielectrophoresis using a plurality of electrodes, and discharging the bubbles gathered around the nozzle through the nozzle by applying a force at the nozzle.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
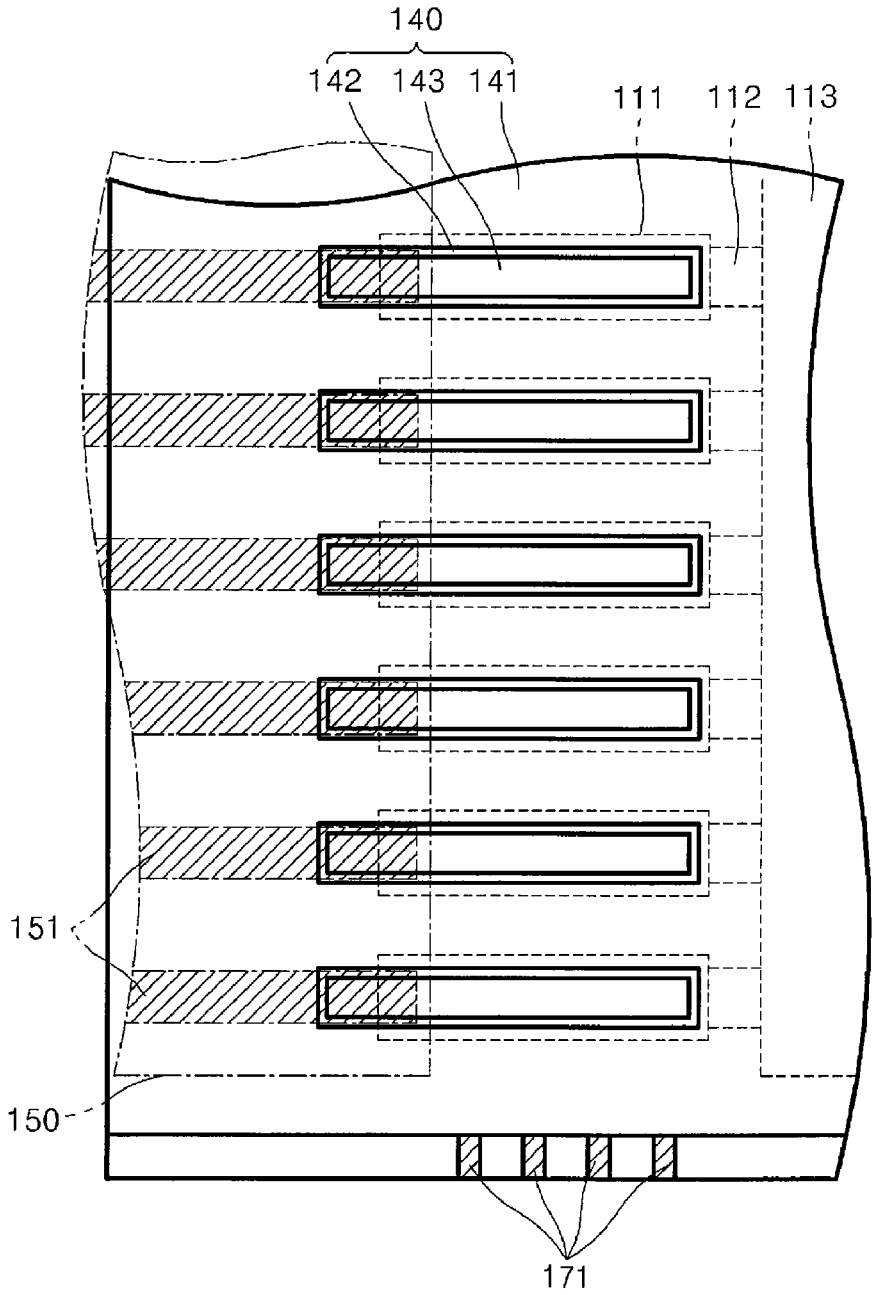
FIG. 1 is a plan view illustrating an inkjet printhead, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures. In the drawings, thicknesses of layers and regions may be exaggerated for clarity. It will also be understood that when a layer or plate is referred to as being "on" another layer or plate, it can be directly on the other layer or plate, or intervening layers or plates may also be present.

Figure 2:
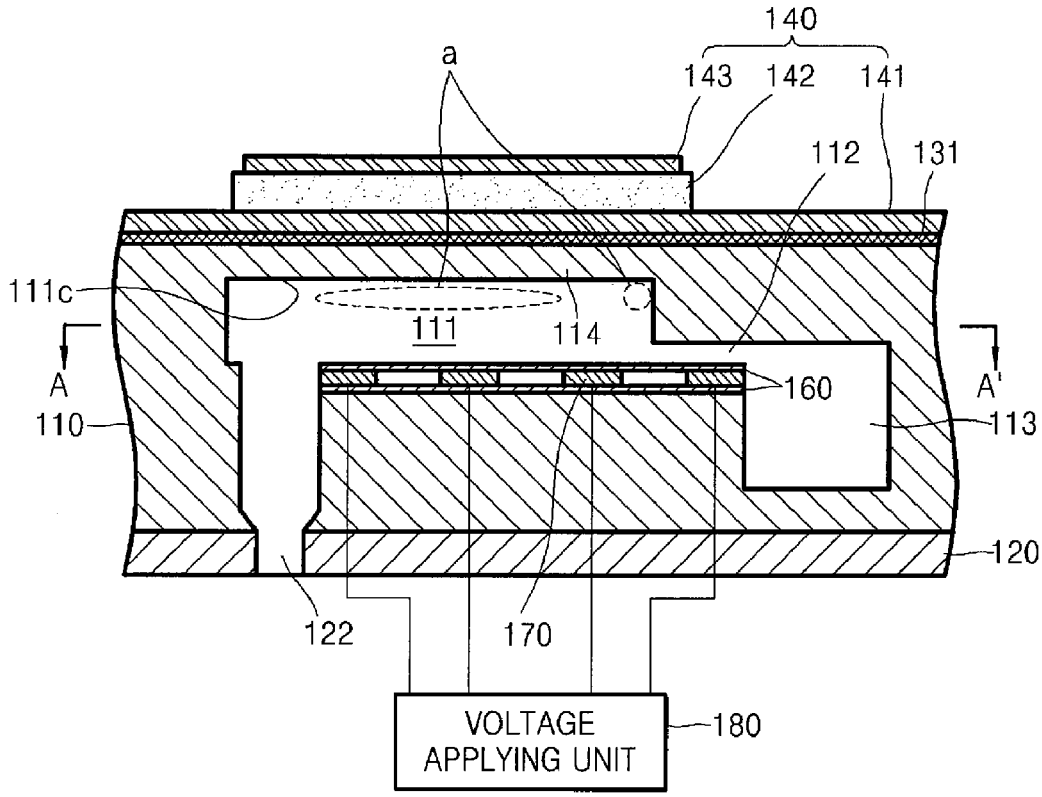
FIG. 2 is a cross-sectional view illustrating the inkjet printhead of FIG. 1.
Figure 3:
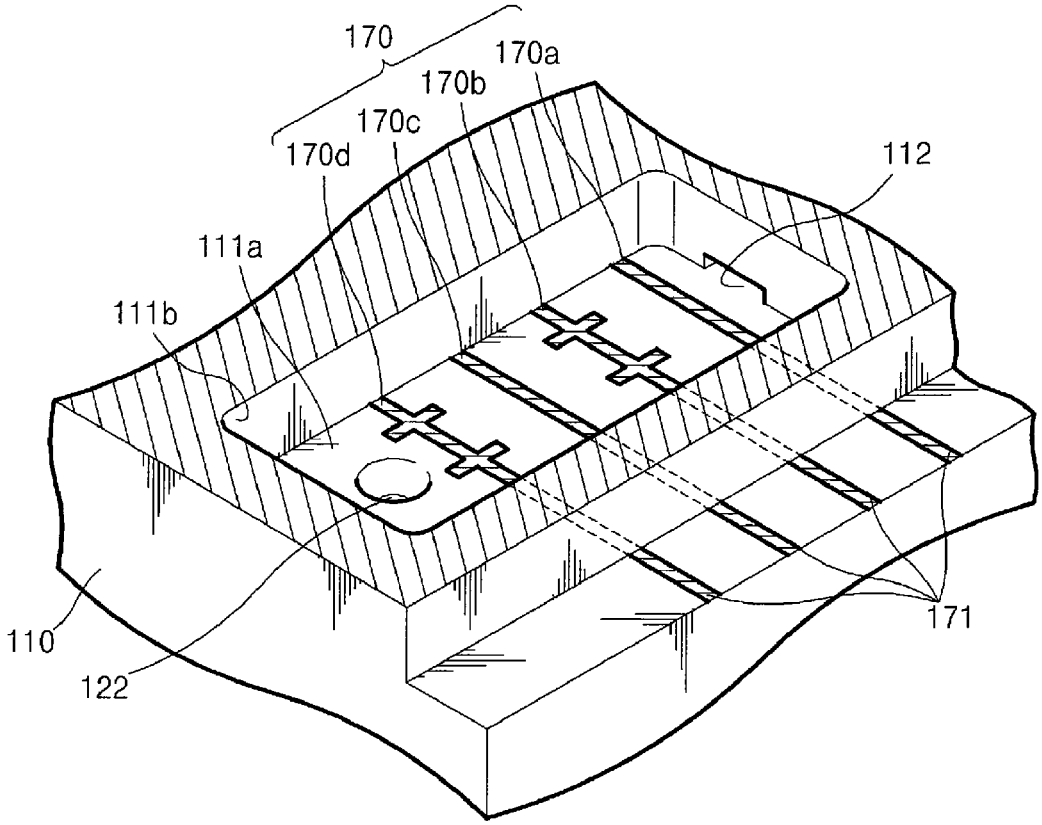
FIG. 3 is a sectional view taken along line A-A of FIG. 2.

FIG. 1 is a plan view illustrating an inkjet printhead according to an embodiment of the present general inventive concept, FIG. 2 is a cross-sectional view illustrating the inkjet printhead of FIG. 2, and FIG. 3 is a sectional view taken along line A-A' of FIG. 2.

Referring to FIGS. 1 and 2, the inkjet printhead includes a flow channel forming plate 110 where an ink flow channel is formed, and a piezoelectric actuator 140 to provide a pressure to eject ink. The flow channel forming plate 110 includes a pressure chamber 111, a manifold 113 to supply ink to the pressure chamber 111, and a restrictor 112. A nozzle plate 120 is bonded to the flow channel forming plate 110, and a nozzle 122 is formed on the nozzle plate 120 to eject ink from the pressure chamber 111. A vibrating plate 114 is disposed on the pressure chamber 111, and is deformable by a driving force provided by the piezoelectric actuator 140. The flow channel forming plate 110 and the nozzle plate 120 define the ink flow channel.

The piezoelectric actuator 140 is formed on the flow channel forming plate 110, and provides the driving force to eject ink to the pressure chamber 111. The piezoelectric actuator 140 includes a lower electrode 141, a piezoelectric layer 142, and an upper electrode 143 stacked sequentially on the flow channel forming plate 110. The lower electrode 141 serves as a common electrode, the piezoelectric layer 142 is deformable by a voltage applied thereto, and the upper electrode 143 serves as a driving electrode.

The lower electrode 141 is formed on the flow channel forming plate 110 including the pressure chamber 111. The flow channel forming plate 110 may be formed of a silicon wafer, and a silicon oxide layer 131 may be formed between the flow channel forming plate 110 and the lower electrode 141. The lower electrode 141 is formed of a conductive metal material. The lower electrode 141 may include one or more metal layers, such as two metal layers. For example, the lower electrode may include Ti and Pt layers. The lower electrode 141 including a Ti/Pt layer can serve not only as a common electrode, but also as a diffusion barrier layer to prevent inter-diffusion between the piezoelectric layer 142 and the flow channel forming plate 110 that are formed respectively on and under the lower electrode 141.

The piezoelectric layer 142 is formed on the lower electrode 141 and is located to correspond to the pressure chamber 111. The piezoelectric 142 may be formed of a piezoelectric material, such as lead zirconate titannate (PZT) ceramic material.

The upper electrode 143 is formed on the piezoelectric layer 142 and serves as the driving electrode to apply a voltage to the piezoelectric layer 142. Wiring 151 of a drive circuit to apply the voltage, for example, a flexible printed circuit 150, may be bonded to an upper surface of the upper electrode 143.

When a driving voltage is applied to the upper electrode 143, the piezoelectric layer 142 is deformed and the vibrating plate 114 bends, thereby changing a volume of the pressure chamber 111. Therefore, the pressure to eject the ink is generated in the pressure chamber 111, and the ink in the pressure chamber 111 is ejected through the nozzle 122.

Air and other gasses dissolved in the ink grow into bubbles by various factors, such as a temperature rise. Also, air flows in the printhead through the nozzle of the printhead during printing. The bubbles in the printhead lower an ejection performance of the printhead. In addition, as the temperature rises, the bubbles expand, which may upset a pressure balance of the ink in the printhead, thereby causing the ink to leak through the nozzle.

Noncharged bubbles are dielectrically polarized in an electric field. A non-uniform electric field provides a force to move the polarized bubbles. A phenomenon where noncharged particles move in the non-uniform electric field is called dielectrophoresis. A main issue in this case is a moving direction. The moving direction depends on a magnitude of a dipole moment by polarization. In the non-uniform electric field, particles having a large dipole moment move toward an electrode to which a high voltage is applied, whereas particles having a small polarization moment move toward an electrode to which a low voltage is applied. The magnitude of the dipole moment depends on a permittivity of the particles. When a permittivity of a vacuum is defined as 1, a permittivity of air that is a main ingredient of the bubbles in the ink is approximately 1.0005. Also, a permittivity of water is approximately 80, and a permittivity of the ink used to print is approximately 10 to 80. Therefore, the permittivity of the ink is generally higher than that of the bubbles, and the bubbles move towards electrodes to which a lower voltage is applied in the non-uniform electric field. A force (f) applied to the bubbles by the non-uniform electric field can be expressed by Equation 1.

$$f = 2\pi r^3 \varepsilon_m \mathrm{Re}\left[\frac{\varepsilon_p - \varepsilon_m}{\varepsilon_p + 2\varepsilon_m}\right] \nabla E^2 \quad (1)$$

where $\epsilon_p$ indicates the permittivity of the bubbles, $\epsilon_m$ indicates the permittivity of the ink, r indicates a radius of bubbles when the bubbles are considered to have a spherical shape, and Re indicates a real component of $$\frac{\varepsilon_p - \varepsilon_m}{\varepsilon_p + 2\varepsilon_m}.$$

As described above, in order to remove the bubbles using dielectrophoresis, the inkjet printhead according to the present embodiment includes a plurality of electrodes 170 to form a non-uniform electric field in the ink flow channel, as illustrated in FIGS. 2 and 3. The electrodes 170 are disposed on a bottom 111*a* of the pressure chamber 111 facing the piezoelectric actuator 140. An insulating layer 160 may be included to insulate the electrodes 170 from the flow channel forming plate 110 and the ink in the pressure chamber 111, as illustrated in FIG. 2. However, the insulating layer 160 may be omitted, as illustrated in FIG. 3. A voltage applying unit 180 applies a voltage to the electrodes 170. The electrodes 170 may have non-uniform features in order to form the non-uniform electric field. For example, the electrodes 170*a* and 170*c* have a flat panel shape extending in a width direction of the pressure chamber 111, and the electrodes 170*b* and 170*d* have a flat panel shape which includes branches protruding in a length direction of the pressure chamber 111. Therefore, the non-uniform electric field is formed between the electrodes 170. The shape of the electrodes 170, a number thereof and an arrangement thereof, is not limited to the example illustrated in FIG. 3. For example, the shape of the electrodes 170 is not limit to the flat panel shape extending in the width direction of the pressure chamber 111 and the flat panel shape which includes the branches protruding in the length direction of the pressure chamber 111. Furthermore, although FIG. 3 illustrates pairs of electrodes 170 in which the electrodes 170 of each pair have the same shape, the present general inventive concept is not so limited. For example, each of the electrodes 170 may have a different shape, or more than two of the electrodes 170 may have the same shape.

The bubbles move towards the electrode(s) 170 (i.e., 170*a*-170*d*) to which a low voltage is applied. The bubbles may be discharged together with the ink by ejecting the ink using the piezoelectric actuator 140 after moving the bubbles around the nozzle 122. Therefore, in applying the voltages to the electrodes 170, a higher voltage is applied to a first portion of the electrodes 170 disposed farther from the nozzle 122, whereas a lower voltage is applied to a second portion of the electrodes 170 disposed closer to the nozzle 122. For example, in FIG. 3, a highest voltage is applied to the electrode 170*a*, whereas a lowest voltage is applied to the electrode 170*d*. The number of the electrodes 170 is not limited. The voltage applying unit 180 applies the voltages to the electrodes 170 through the terminals 171 of the electrodes 170.

Figure 4:
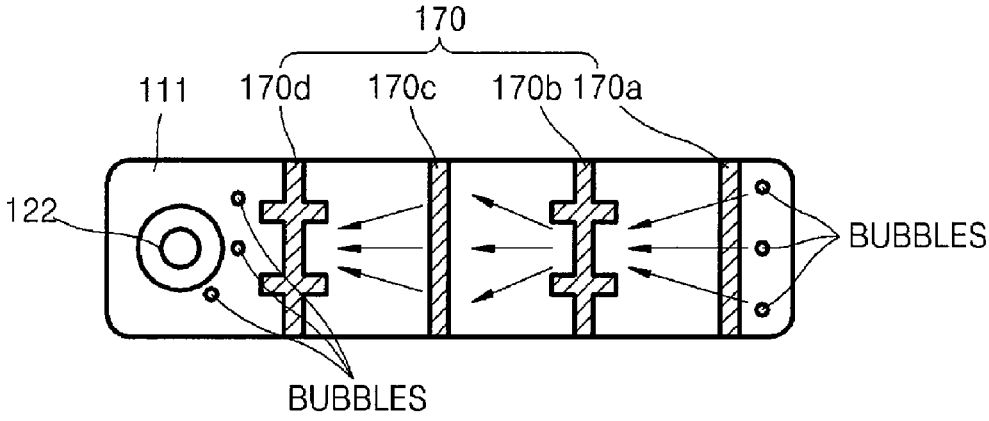
FIG. 4 is a view illustrating a movement of bubbles by a non-uniform electric field formed by a plurality of electrodes in the inkjet printhead of FIG. 1, according to an embodiment of the present general inventive concept.

A method of removing bubbles in a printhead having the aforementioned structure will now be described. When voltages are applied to the electrodes 170, a non-uniform electric field is formed between the electrodes 170. A force defined by Equation 1 is applied to the bubbles by a dipole moment generated by polarization of the bubbles and by a slope of the non-uniform electric field. The bubbles that have a smaller permittivity than ink move towards a first portion of the electrodes 170 to which a low voltage is applied. For example, referring to FIGS. 3 and 4, the bubbles sequentially move from the electrode 170*a* to the electrode 170*d* to gather around the nozzle 122, as denoted by arrows in FIG. 4. Next, a driving voltage is applied to the upper electrode 143 through the wires (lines) 151 of the flexible printed circuit 150 to eject the ink. Then, the bubbles gathered around the nozzle 122 are discharged together with the ink through the nozzle 122.

Conventionally, negative pressure is provided through a nozzle to forcibly suck bubbles as well as ink through the nozzle. In general, bubbles existing near walls of an inkjet printhead or in a corner of an ink flow channel (a portion denoted by "a" in FIG. 2) of the inkjet printhead are not easily removed with the conventional method. Such bubbles have a great effect on a driving performance of a piezoelectric actuator or a thermal actuator. However, in an inkjet printhead and a method of removing bubbles in the inkjet printhead according to embodiments of the present general inventive concept, since bubbles gather around the nozzle 122 using dielectrophoresis, the bubbles existing near walls or in a corner of the ink flow channel can be easily removed. Accordingly, a decrease in an ejection speed of ink droplets by the bubbles, a non-uniformity of a volume of the ink droplets, a lowering of an ejection frequency, etc., can be prevented. Also, since the bubbles are discharged by ejecting ink after gathering the bubbles around the nozzle 122, an amount of ink consumed to remove the bubbles can be significantly reduced.

As discussed above, and as illustrated in FIG. 3, the electrodes 170 may be disposed on the bottom 111*a* of the pressure chamber 111, but the scope of the present general inventive concept is not limited to this. The electrodes 170 can be disposed on any walls forming the pressure chamber 111, as well as a sidewall 111*b* of the pressure chamber 111. However, the electrodes 170 should not be disposed on a ceiling 111*c* of the pressure chamber 111 because a piezoelectric actuator 140 is disposed on the pressure chamber 111. Also, the electrodes 170 may extend toward the restrictor 112.

Figure 5:
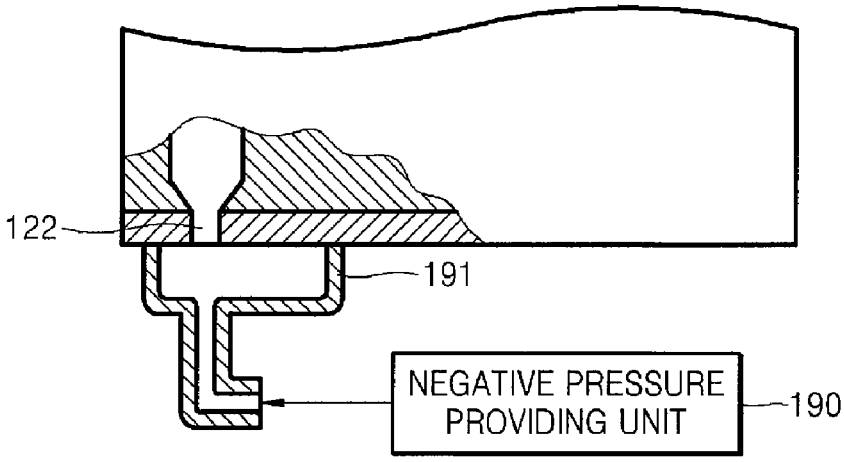
FIG. 5 is a view illustrating a sucking of ink to remove bubbles in the inkjet printhead of FIG. 1, according to an embodiment of the present general inventive concept.

As illustrated in FIG. 5, the nozzle 122 is capped with a nozzle cap 191 after gathering the bubbles around the nozzle 122 by applying the voltages to the electrodes 170, and then the bubbles as well as the ink can be sucked out through the nozzle 122 using a negative pressure providing unit 190. The negative pressure providing unit 190 may be, for example, a vacuum pump. In this case, since most of the bubbles have already gathered around the nozzle 122, an amount of the sucked ink can be significantly reduced in comparison to the conventional method of removing the bubbles by suction. Since the negative pressure f to suck the ink and the bubbles can be also lowered, a risk of damaging the ink flow channel due to an excessive negative pressure can be reduced.

Also, a variable-frequency, traveling-pulse voltage may be applied to the electrodes 170. Therefore, the bubbles can move around the nozzle 122 more quickly by accelerating the bubbles moving towards a portion of the electrodes 170 to which a low voltage is applied.

The structure of the flow channel forming plate 110, the nozzle plate 120, and the piezoelectric actuator 140 illustrated in FIGS. 1 and 2 is only an example. Therefore, the ink flow channel can be formed in the inkjet printhead to have various structures, and can be formed using a plurality of plates, such as more than two plates (i.e., the flow channel forming plate 110 and the nozzle plate 120 illustrated in FIG. 1). Also, the structure of the piezoelectric actuator 140 and the structure to connect the piezoelectric actuator 140 with the drive circuit to apply a voltage may be modified. That is, the present general inventive concept is limited to the structure of the ink flow channel, the ink ejecting method, etc., illustrated in FIGS. 1-5.

A method of removing the bubbles using a plurality of electrodes can also be applied to a thermal inkjet printhead employing a thermal actuator that generates bubbles in a pressure chamber using heat and ejects ink by expansion of the bubbles, in addition to being applied to a piezoelectric actuator.

An inkjet printhead and a method of removing the bubbles therein according to embodiments of the present general inventive concept have at least the following advantages.

Since the bubbles are gathered around a nozzle by dielectrophoresis using a plurality of electrodes, the bubbles existing around walls and in a corner of an ink flow channel can be easily removed. Therefore, an optimum ejection performance of the printhead can be maintained. Furthermore, since the bubbles are gathered around the nozzle and then are discharged through the nozzle, an amount of ink consumed to remove the bubbles can be significantly reduced. In addition, a voltage of a variable-frequency traveling pulse may be applied to the plurality of electrodes to accelerate the bubbles, allowing the bubbles to move more quickly around the nozzle.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet printhead, comprising:

an ink flow channel including a pressure chamber to contain ink;

a nozzle to communicate with the pressure chamber;

an actuator to provide a driving force to eject the ink from the pressure chamber; and a plurality of electrodes which are disposed, facing the actuator, in the bottom of the pressure chamber away from the nozzle to form a non-uniform electric field according to applied voltages in the pressure chamber such that the electric field causes moving of bubbles contained in the pressure chamber out of the nozzle, wherein the plurality of electrodes are disposed on walls forming the ink flow channel.

2. The inkjet printhead of claim 1, wherein the voltages are variable-frequency, traveling-pulse voltages.

3. A printhead, comprising:

a chamber layer comprising an ink chamber to contain ink;

a nozzle layer disposed on the chamber layer and comprising a nozzle in communication with the ink chamber to eject the ink from the ink chamber;

an actuator to provide a driving force to eject the ink from the ink chamber through the nozzle; and a plurality of electrodes disposed, facing the actuator, in the bottom of the ink chamber away from the nozzle to move bubbles in the ink contained in the ink chamber out of the nozzle, wherein the plurality of electrodes generates a non-uniform electric field in the ink chamber to dielectrically polarize the bubbles and applies a force to move the polarized bubbles towards the nozzle, wherein the plurality of electrodes is disposed on a wall of the ink chamber.

4. The printhead of claim 3, wherein the plurality of electrodes move the bubbles in the ink to the nozzle using dielectrophoresis.

5. The printhead of claim 3, wherein shapes of at least a portion of the plurality of electrodes are non-uniform shapes.

6. The printhead of claim 5, wherein the non-uniform shapes include at least one of a flat panel shape extending in a width direction of the ink chamber, and a flat panel shape including branches protruding in a length direction of the ink chamber.

7. The printhead of claim 3, further comprising:

a voltage applying unit to apply voltages to the plurality of electrodes.

8. The printhead of claim 7, wherein the voltage applying unit applies a first voltage to a portion of the plurality of electrodes disposed closer to the nozzle, and applies a second voltage to a portion of the plurality of electrodes disposed farther from the nozzle.

9. The printhead of claim 8, wherein the first voltage is lower than the second voltage.

10. The printhead of claim 7, wherein the voltages applied by the voltage applying unit are variable-frequency traveling pulse voltages to accelerate the movement of the bubbles towards the nozzle.

11. The printhead of claim 3, wherein the actuator is selected from a thermal actuator and a piezoelectric actuator.

12. The printhead of claim 3, wherein the chamber layer further comprises:

a manifold to supply ink to the ink chamber; and a restrictor to restrict a back flow of ink from the ink chamber to the manifold

* * * * *